US009728065B2

(12) United States Patent
Jarvis et al.

(10) Patent No.: US 9,728,065 B2
(45) Date of Patent: Aug. 8, 2017

(54) METALLIC CONDUCTOR DISTURBANCE DETECTION DEVICE AND METHOD

(71) Applicant: Cresatech Limited, Cumbria (GB)

(72) Inventors: Simon James Jarvis, Cumbria (GB); Paul Mumford, Hampshire (GB); Roger Merchant, St. Paul, NE (US)

(73) Assignee: CRESATECH LIMITED, Cumbria (GB)

( * ) Notice: Subject to any disclaimer, the term of this patent is extended or adjusted under 35 U.S.C. 154(b) by 42 days.

(21) Appl. No.: 14/122,595

(22) PCT Filed: Jan. 25, 2013

(86) PCT No.: PCT/GB2013/050165
§ 371 (c)(1),
(2) Date: Nov. 26, 2013

(87) PCT Pub. No.: WO2013/117905
PCT Pub. Date: Aug. 15, 2013

(65) Prior Publication Data

US 2015/0022364 A1 Jan. 22, 2015

(30) Foreign Application Priority Data

Feb. 8, 2012 (GB) ..... 1202202.6
Sep. 14, 2012 (GB) ..... 1216492.7

(51) Int. Cl.
*G08B 21/18* (2006.01)
*G08B 13/12* (2006.01)

(52) U.S. Cl.
CPC ..... *G08B 21/185* (2013.01); *G08B 13/12* (2013.01)

(58) Field of Classification Search
CPC ..... G08B 21/185; G08B 13/12
See application file for complete search history.

(56) References Cited

U.S. PATENT DOCUMENTS 3,573,783 A * 4/1971 Fudaley ..... G08B 13/26 307/116
3,848,243 A 11/1974 Schirmer
(Continued)

FOREIGN PATENT DOCUMENTS

GB 2317707 A * 4/1998 ..... G01R 31/2829
JP 07-294233 A 11/1995

OTHER PUBLICATIONS

Search Report for GB1216492.7 completed Oct. 2, 2012.
(Continued)

*Primary Examiner* — James Yang
(74) *Attorney, Agent, or Firm* — Robert C. Klinger

(57) ABSTRACT

A method of detecting disturbance in a metallic conductor, comprises the steps of providing an inductance sensing circuit in mechanically and electrically connected to a metallic conductor having a monitorable inductance, tuning the inductance sensing circuit based on an electromagnetic field impressed upon the metallic conductor and an internally generated circuit oscillation, and outputting an alert signal when a tuned output signal from the tuned inductance sensing circuit becomes detuned due to a change in inductance of the metallic conductor by addition to or removal of at least a portion of the metallic conductor. A metallic conductor disturbance detection device for such a method is also provided, the device comprising an amplitude and/or frequency tunable inductance sensing circuit, and an alarm circuit for outputting an alarm signal based on an output of the inductance sensing circuit.

15 Claims, 9 Drawing Sheets

(56) References Cited

U.S. PATENT DOCUMENTS

| | | | | |
|---|---|---|---|---|
| 3,989,932 | A | 11/1976 | Koerner | |
| 4,518,953 | A * | 5/1985 | Hunter | G08B 13/122 256/10 |
| 4,757,277 | A * | 7/1988 | Nakase | H03F 3/191 330/306 |
| 5,463,317 | A | 10/1995 | Murphy | |
| 2010/0085189 | A1 | 4/2010 | Caswell | |
| 2010/0328072 | A1* | 12/2010 | Price | G08B 13/1409 340/568.3 |
| 2011/0251809 | A1 | 10/2011 | Stollenwerk | |

OTHER PUBLICATIONS

International Search Report and Written Opinion for PCT/GB2013/050165 mailed Jun. 25, 2013.
First Examination Report from Australia.
First Examination Report from New Zealand dated Dec. 8, 2014.
First Examination Report from China dated Sep. 8, 2015.

* cited by examiner

METALLIC CONDUCTOR DISTURBANCE DETECTION DEVICE AND METHOD

CROSS-REFERENCE TO RELATED APPLICATION(S)

The present application claims priority under 35 U.S.C. §365 to International Patent Application No. PCT/GB2013/050165 filed Jan. 25, 2013. International Patent Application No. PCT/GB2013/050165 claims priority under 35 U.S.C. §365 and/or 35 U.S.C. §119(a) to United Kingdom Patent Application No. 1202202.6 filed Feb. 8, 2012 and United Kingdom Patent Application No. 1216492.7 filed Sep. 14, 2012 which are incorporated herein by reference into the present disclosure as if fully set forth herein.

TECHNICAL FIELD

The present invention relates to a metallic conductor disturbance detection device, and to a method of detecting disturbance in or in the vicinity of a metallic conductor.

BACKGROUND

Due to their rapidly increasing value, incidents of tampering and/or removal of metal conductors, such as copper or aluminium, in metallic infrastructures such as telecommunications sites and transport sites have risen steadily over recent years, and are thus becoming a problem worldwide.

Additionally, being able to monitor for natural degradation in metallic conductors, due to corrosion or accidentally inflicted damage, would be beneficial.

In an attempt to combat the widespread theft of such metallic conductors, a number of solutions have been proposed. These solutions can generally be divided into three categories: prevention of thieves or unauthorised persons getting onto or into the site; detection of thieves or unauthorised persons whilst on the site; and catching the thieves or 'handlers' receiving the illegally removed materials after the event.

Prevention typically includes security fencing, including electric fencing, but has not proved effective in preventing entry of determined thieves.

Detection primarily utilises established 'traditional' security technology for detecting thieves when on site. The technology used is predominantly Monitored CCTV, Movement and Sound Sensors. Monitored site CCTV can provide notice of thieves on site, but does not confirm what has been removed. Furthermore, it is also still prohibitively expensive for most sites. Devices such as movement and sound sensors are prone to false alarms in such site environments, due for example to animals passing through the site, which adds to operational costs and inconvenience.

The third approach is to ensure capture of the thieves or handlers after the event. The most established approaches and technologies in this area are: SmartWater® which provides invisible traceability of the material stolen and has proved very effective in addressing the resale of the stolen materials; printing the owner identification on the sheathing/casing, which is a deterrent but as a common practice can be burnt off; and 'Land Mines' containing visible and/or invisible dye and which detonates upon being disturbed when thieves are in unauthorized areas. This latter arrangement is a recent development which again will aid in the identification of thieves.

SUMMARY

The present invention falls into the category of detection, thereby aiming to prevent or limit removal of and/or damage to the metallic conductors in the first place, and thereby improving safety and decreasing operational downtime.

According to a first aspect of the invention, there is provided a method of detecting disturbance in a metallic conductor, the method comprising the steps of providing an inductance sensing circuit mechanically and electrically connected to a metallic conductor having a monitorable inductance, tuning the inductance sensing circuit based on an electromagnetic field impressed upon the metallic conductor and an internally generated circuit oscillation, and outputting an alert signal when a tuned output signal from the tuned inductance sensing circuit becomes detuned due to a change in inductance of the metallic conductor by addition to or removal of at least a portion of the metallic conductor.

Preferable and/or optional features of the first aspect of the invention are set forth in claims 2 to 15, inclusive.

According to a second aspect of the invention, there is provided a metallic conductor disturbance detection device for a method of detecting disturbance in a metallic conductor, the device comprising an amplitude and/or frequency tunable inductance sensing circuit which is mechanically and electrically connected to the metallic conductor, and an alarm circuit for outputting an alarm signal based on an output of the inductance sensing circuit by addition to or removal of at least a portion of the metallic conductor.

According to a third aspect of the invention, there is provided a metallic conductor disturbance detection device for detecting disturbance in a metallic conductor, the device comprising an inductance sensing circuit including a transformer having first and second primary windings and a secondary winding, and a tunable oscillator in electrical communication with the first primary winding of the transformer, the second primary winding being mechanically and electrically communicable with a metallic infrastructure, and the secondary winding being able to output a tuned output signal based on a first condition of the metallic infrastructure, and a detuned output signal based on a second condition of the metallic infrastructure caused by addition to or removal of at least a portion of the metallic conductor.

According to a fourth aspect of the invention, there is provided a metallic conductor disturbance detection device in mechanical and electrical communication with a metallic infrastructure, the device comprising an inductance sensing circuit including a transformer having first and second primary windings and a secondary winding, and a tunable oscillator in electrical communication with the first primary winding of the transformer, the second primary winding in mechanical and electrical communication with the metallic infrastructure, and the secondary winding outputting a tuned output signal based on an untampered condition of the metallic infrastructure and a detuned output signal based on a tampered condition of the metallic infrastructure.

According to a fifth aspect of the invention, there is provided a method of detecting disturbance in a metallic conductor, the method comprising the steps of providing an inductance sensing circuit electrically connected to a metallic conductor having a monitorable inductance, tuning the inductance sensing circuit based on an electromagnetic field impressed upon the metallic conductor and an internally generated circuit oscillation, and outputting an alert signal when a tuned output signal from the tuned inductance sensing circuit becomes detuned due to a change in inductance of the metallic conductor by addition to or removal of at least a portion of the metallic conductor.

According to a sixth aspect of the invention, there is provided a method of detecting disturbance in a metallic conductor, the method comprising the steps of providing an inductance sensing circuit in electrical and mechanical communication with a metallic conductor having a monitorable inductance, tuning the inductance sensing circuit by utilising an oscillator which impresses an electromagnetic field on the metallic conductor, and outputting an alert signal when a tuned output signal from the tuned inductance sensing circuit becomes detuned due to a change in inductance of the metallic conductor by addition to or removal of at least a portion of the metallic conductor.

BRIEF DESCRIPTION OF THE DRAWINGS

The invention will now be more particularly described, by way of example only, with reference to the accompanying drawings, in which.

DETAILED DESCRIPTION

Figure 1A:
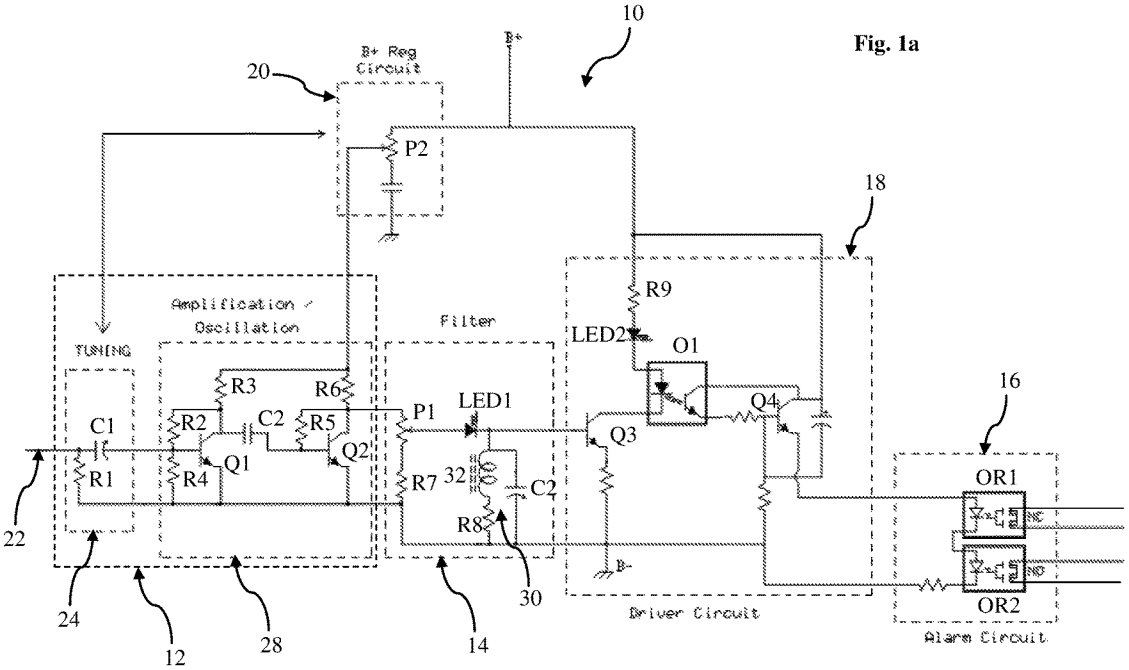
FIG. 1*a* shows a circuit diagram of a first embodiment of a metallic conductor disturbance detection device, in accordance with the second aspect of the invention and shown with circuit modules identified for clarity.
Figure 1B:
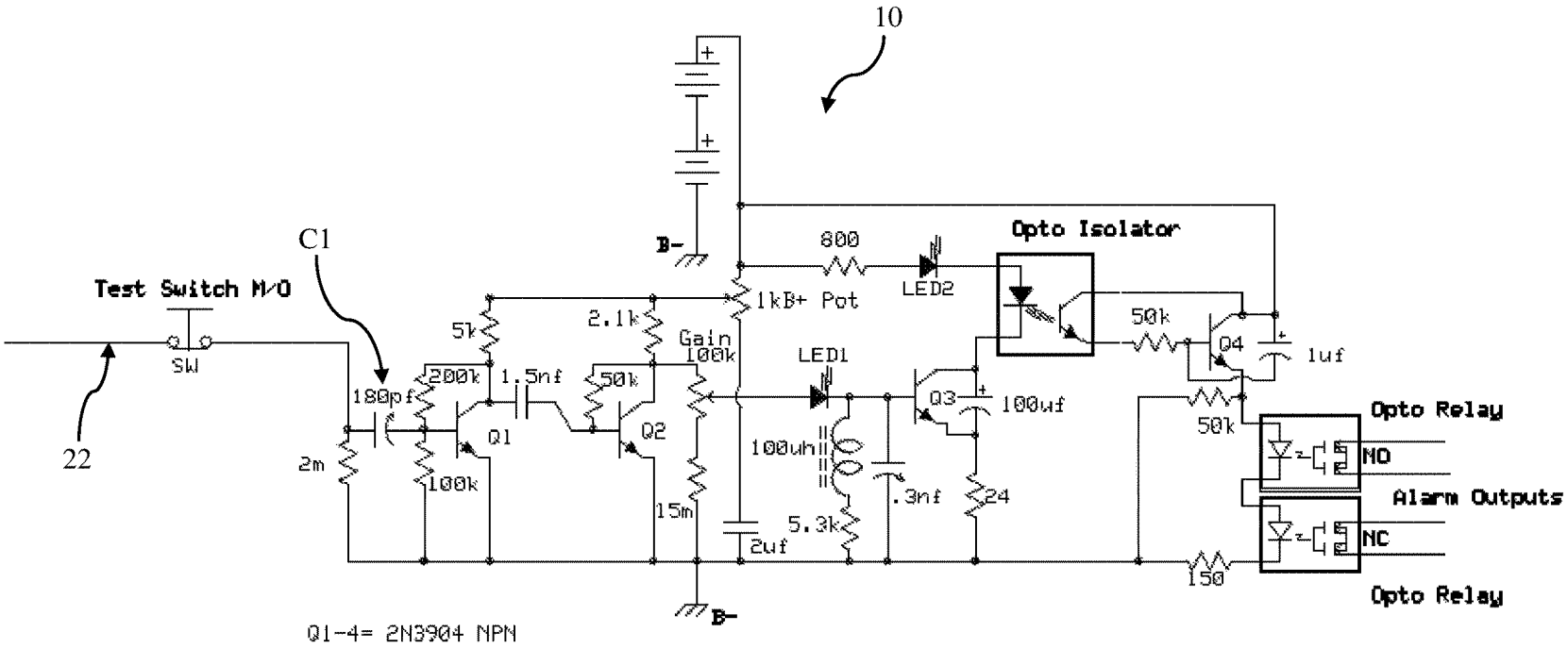
FIG. 1*b* shows the circuit diagram of FIG. 1*a* with the electrical components referenced for clarity.

Referring firstly to FIGS. 1*a* and 1*b* of the invention, a first embodiment of a metallic conductor disturbance detection device 10 is shown which comprises an inductance sensing circuit 12, a filter circuit 14 connected to an output of the inductance sensing circuit 12, and an alarm circuit 16 for outputting an alarm signal based on an output of the filter circuit 14. The device 10 preferably further comprises a driver circuit 18 for driving the inductance sensing circuit 12, filter circuit 14 and/or the alarm circuit 16, and additionally or alternatively a voltage regulation circuit 20.

A sense wire 22 passes into the sensing circuit 12 via a momentary push button test switch SW located on a left side of the sensing circuit 12.

From the test switch SW, a connection is made to a tunable capacitor C1 forming part of a tuning circuit 24 of the sensing circuit 12. For the present embodiment, the tunable capacitor C1 has a value range between 9 and 180 Pico Farads, and is utilised to regulate or couple the device 10 to the metallic conductor forming part of the metallic infrastructure 26 to be monitored.

If added stability is deemed desirable or necessary for the proper operation of the circuit, a 2 MΩ resistor R1 between the input of the tunable capacitor C1 and a B− of the device 10 may be employed to shunt a portion of the impressed signal to ground, thereby limiting the initial gain the sensing circuit will have and preventing it from becoming saturated.

The tunable capacitor C1 is connected to a base of transistor Q1, in this case being an NPN Small signal transistor, and which forms a first stage of an amplification/oscillation circuit 28 of the sensing circuit 12.

A biasing resistor R2 of approximately 200 KΩ is connected from a collector junction of transistor Q1 to a base junction to provide the necessary biasing of the transistor Q1.

A 5KΩ resistor R3 from B+ to the collector of transistor Q1 provides for regulation of the voltage at transistor Q1.

It may also be desirable, depending upon the application, to employ a shunt resistor R4 of approximately 100 KΩ from the base connection of transistor Q1 to ground to further stabilize the device 10 if it is employed in an application where the risk of over saturation of the base of the first said transistor Q1 may become an issue.

In use, an incoming signal of a given frequency and amplitude is mixed with a local oscillation produced by the amplification/oscillation circuit 28 comprising transistor Q1. The signal is then fed via a fixed ceramic capacitor C2 of approximately 1.5 Nano Farads into a base junction of a second transistor Q2, wherein the combined signal is amplified still further in the same manner and configuration as transistor Q1.

A 50 KΩ resistor R5 providing a bias voltage from the collector to base is employed, and a 2.1 KΩ resistor R6 between B+ and the collector junction is preferably utilised on transistor Q2.

The input signal at this point has been sufficiently amplified by the amplification/oscillation circuit 28 and is directly fed into a 100 KΩ pot P1 that is employed as an output gain control. The 100 KΩ pot P1 is connected to B− via a very high value resistor R7, which in the present case has a value of 15 MΩ, but the value of the resistance can be as small as 2 MΩ and still give good results.

A wiper of the 100 KΩ pot P1 is then fed to an anode of a first LED, referenced as LED 1, to provide one form of visual indication of the operational status of the device 10. A cathode connection of LED 1 is connected to a tunable band pass filter 30 of the filter circuit 14 which is in parallel with an output of said LED 1 and B−.

The filter circuit 14 communicating with the output of the amplification/oscillation circuit 28 in this case comprises a 100 μH coil 32 which is in series with a 5.3 KΩ resistor R8 to B−. A variable capacitor C2 of 0.3 Nano Farad is in parallel with the coil 32 and resistor R8. The band pass filter 30 of the filter circuit 14 can thus be tuned by varying the capacity with respect to the coil inductance if it is deemed desirable to change the characteristics of the band pass filter 30 for a specific application.

A further cathode is also connected to a base junction of a driver transistor Q3 forming part of a driver circuit 18 of the device 10. The driver circuit 18 is utilised to regulate an operational status of an opto isolator O1 outputting to the alarm circuit 16.

In a normal operating condition, the driver transistor Q3 is in a semi-ON condition ideally about halfway between full ON and full OFF conditions thereby providing a null condition. To achieve the desired adjustment, a second LED, referenced as LED 2, is provided as a visual indicator for tuning purposes.

By adjustment of the tunable capacitor C1 of the tuning circuit 24, the 100 KΩ gain pot P1 of the filter circuit 14, and B+ via the voltage regulation circuit 20, correct tuning of the device 10 is achievable and the device 10 can be rendered to a sensitive state.

The positive voltage B+ feeding the device 10 is preferably adjustable by a 1 KΩ pot P2 in series with the B+ voltage supply and the amplification/oscillation circuit 28 of the device 10. In practice, this pot P2 is typically adjusted to some ideal or optimum value and will require little or no further adjustment in the field thereafter, wherein the primary means of adjusting the device 10 to a tuned state will be via the adjustments of the variable capacitor C1 of the tuning circuit 24 and the 100 KΩ output gain pot P1 of the filter circuit 14.

To prevent damage to LED 2, an 800Ω resistor R9 is provided in series with an anode of LED 2 to limit potentially damaging current. At this point, the opto isolator O1 is biased to an ON state wherein a bias voltage passes through an additional transistor Q4 to drive opto relays OR1, OR2 provided in the alarm circuit 16.

Figure 2:
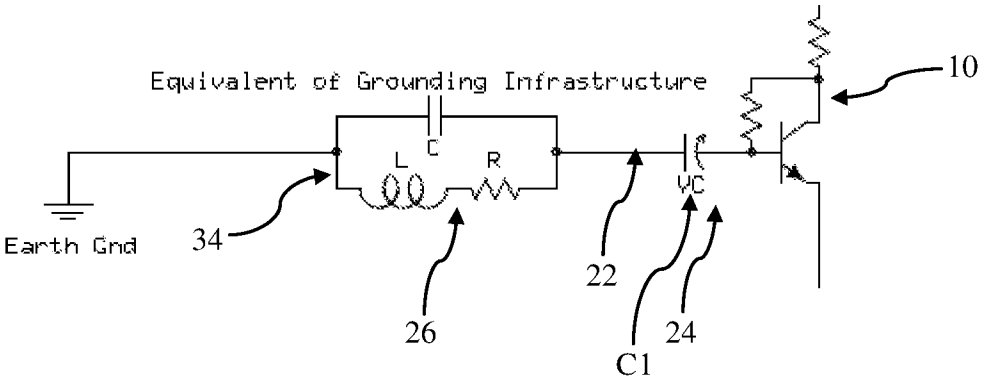
FIG. 2 is a circuit diagram showing an electrical representation of a metallic conductor to be monitored by the metallic conductor disturbance detection device of FIGS. 1*a* and 1*b;*

Referring to FIG. 2, an electrical representation of a metallic conductor 34 forming part of the metallic infrastructure 26, such as a telecommunications mast or site, a utility site, for example, an electricity substation, and/or a transport site, for example, a railway signalling site, and how the tuning circuit 24 of the sensing circuit 12 is connected thereto will be described.

In this case the metallic conductor 34 is earth grounded such as would be found in a grounding grid. The monitored metallic conductor 34, for example, being copper and typically of a certain length, possess a specific natural inductance as well as natural capacity if the conductor 34 is either positioned slightly above earth or within the same. As the metallic conductor 34 forms a layer of oxidization owing to contact with air and/or soil, a slight capacity is formed by the oxide layer.

The metallic conductor 34 also has a natural resistance depending upon the length of the said conductor 34. The resistance can be very low or may exceed 1Ω or more if it's of a great length. It then may be said that owing to the presence of Inductance, Capacity, and Resistance, referred hereinafter as 'LC&R', the structure will tend to form a tuned circuit owing to the presence of LC&R.

Present within the earth is a plethora of stray currents, both natural and manmade, as well as the presence of low and high frequency alternating currents that can reach into the low radio frequency or RF spectrum. These currents and voltages are induced in the metallic infrastructure 26 owing to its communication with the earth. It is known that such voltages and currents can be read from the metallic conductor 34 either by a voltmeter or an oscilloscope, and will result in both a frequency and amplitude reading. These currents and voltages form part of the means by which changes can be monitored if the metallic conductor 34 of the infrastructure 26 is disturbed in some manner.

The complete circuit of the device 10 also generates an oscillation that can be measured on the ground infrastructure 26, and in this invention is combined with the signals already present in or on the metallic conductor 34 to be monitored in order to detect any changes taking place.

When the metallic conductor 34 is disturbed, such as by removal or damage to a portion thereof, a change of voltages and amplitude of the impressed frequencies is received by the device 10 resulting in an alarm condition being generated. It is also understood that changes to the voltages and amplitudes of the impressed frequencies, or in other words the conductive characteristics, of the monitored metallic conductor 34 can also result due to natural corrosion of and/or a body coming within close proximity to the metallic conductor 34. In this case, an alarm condition also occurs.

Figure 3:
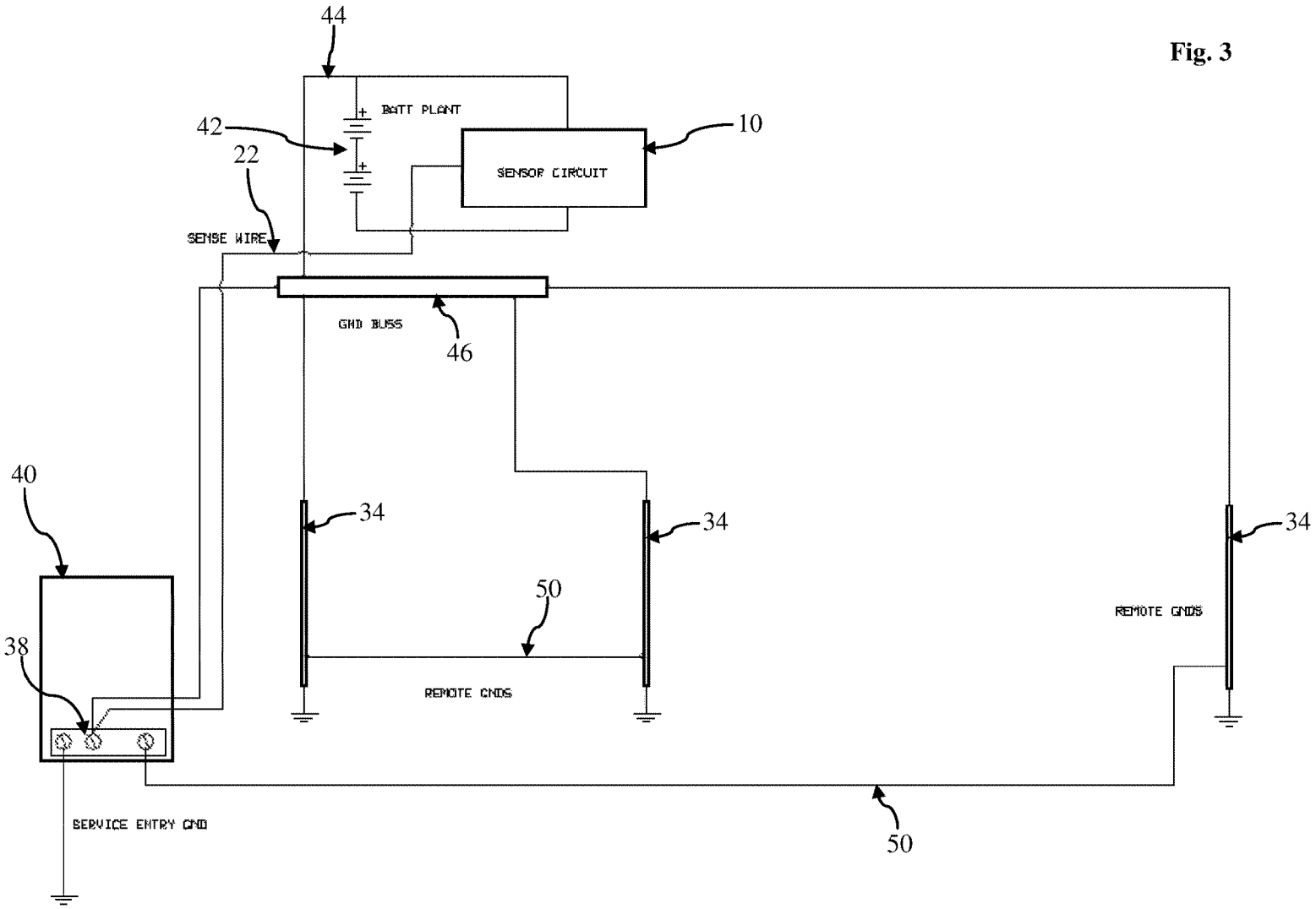
FIG. 3 shows a block circuit diagram of a first example of a connection between the metallic conductor disturbance detection device and a metallic infrastructure comprising at least one metallic conductor, in accordance with the first aspect of the invention.

FIG. 3 shows a first example of the metallic conductor disturbance detection device 10 arranged to monitor a grounded metallic conductor 34 of a monitored infrastructure 26. An input of the tuning circuit 24 of the device 10 is mechanically connected via the electrical sense wire, lead or cable 22 to one portion of a grounding grid, which in this example is illustrated as a connection to a ground terminal 38 of a power service entry box 40 serving as a primary single grounding point for the site.

From a power supply 42, in this case being for example a battery plant, supplying power to the device 10 and possibly other site electronics, a further wire 44 is often taken to ground the power supply 42. This can be a positive ground as shown in FIG. 3, or a negative ground as shown in FIG. 4.

In some applications of the present invention, a second connection to the battery plant or other power supply 42 and to the device 10 is also employed as a second sense path for monitoring changes within the or another metallic conductor 34 of the monitored infrastructure 26.

A buss bar or master ground buss 46 forms part of the monitored infrastructure 26 and is in electrical communication with the metallic conductor or conductors 34. The various structures are at ground potential and are interconnected and grounded to the master buss 46. Typically, these structures are connected or bonded together and to the ground buss 46 via copper cable of reasonably large diameter both buried within the earth as well as above the earth. In some applications, a further ground grid remote from the service entry grid 40 is connected or bonded to both the master ground buss 46 and the service entry ground 38 thereby forming a ground loop. Typically, in such networks one or more ground loops 50 will exist within the infrastructure 26 as indicated in the drawing of FIG. 3. When any portion of the infrastructure 26 is tampered with or removed, there will be a corresponding change typically in amplitude and/or inductance of the impressed signal within the infrastructure 26 and as before mentioned, this change triggers an alarm condition in the device 10.

Figure 4:
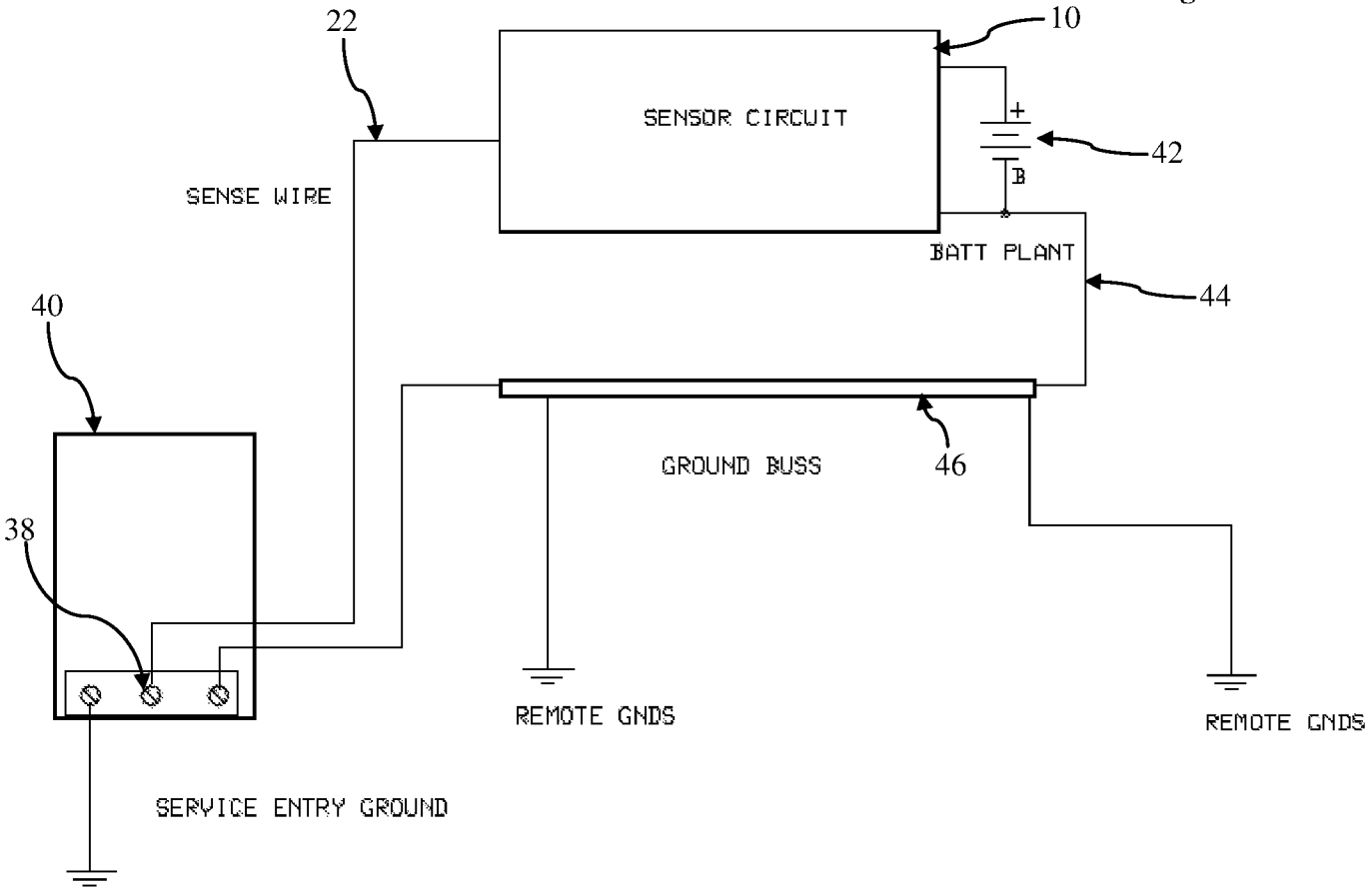
FIG. 4 shows a block circuit diagram of a second simplified example of a connection between the metallic conductor disturbance detection device and a metallic infrastructure comprising at least one metallic conductor, in accordance with the first aspect of the invention.

Referring to FIG. 4, a second example of the connection of the metallic conductor disturbance detection device 10 to a monitored infrastructure 26 having one or more metallic conductors 34 is shown. The arrangement of FIG. 4 is a simplified version of FIG. 3, wherein the further ground grids as described previously are omitted. The input of the tuning circuit 24 is mechanically connected via an electrical sense cable, wire or lead 22 to a power distribution board or other service entry unit 40. The power supply 42 is preferably grounded to the buss bar or master ground buss 46, as before. Operation is therefore in much the same manner as the first example above.

Figure 5:
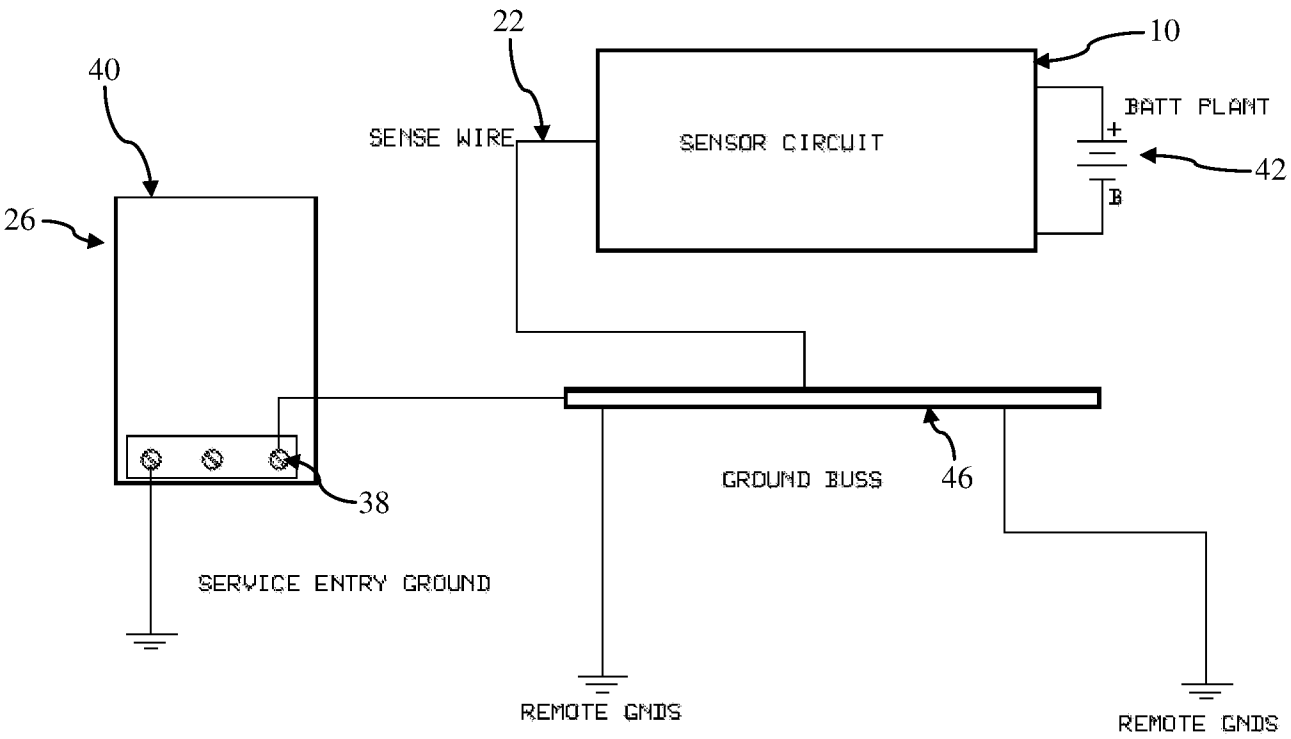
FIG. 5 shows a block circuit diagram of a third example of a connection between the metallic conductor disturbance detection device and a metallic infrastructure comprising at least one metallic conductor, wherein only a single connection is required between the device and the conductor, again in accordance with the first aspect of the invention.

FIG. 5 illustrates a third example of the connection of the metallic conductor disturbance detection device 10 to a monitored infrastructure 26 having one or more metallic conductors 34. The interconnection in this example is different to that of the preceding two examples. In this case, the battery plant or power supply 42 may be independent or 'floating' with respect to the metallic infrastructure 26. As such, only a single connection via the tuning circuit 24 to the infrastructure 26 to be monitored is required. When the device has therefore been properly adjusted, it is capable of detecting changes within said infrastructure 26 with only a single connection being made to the device 10.

Figure 6:
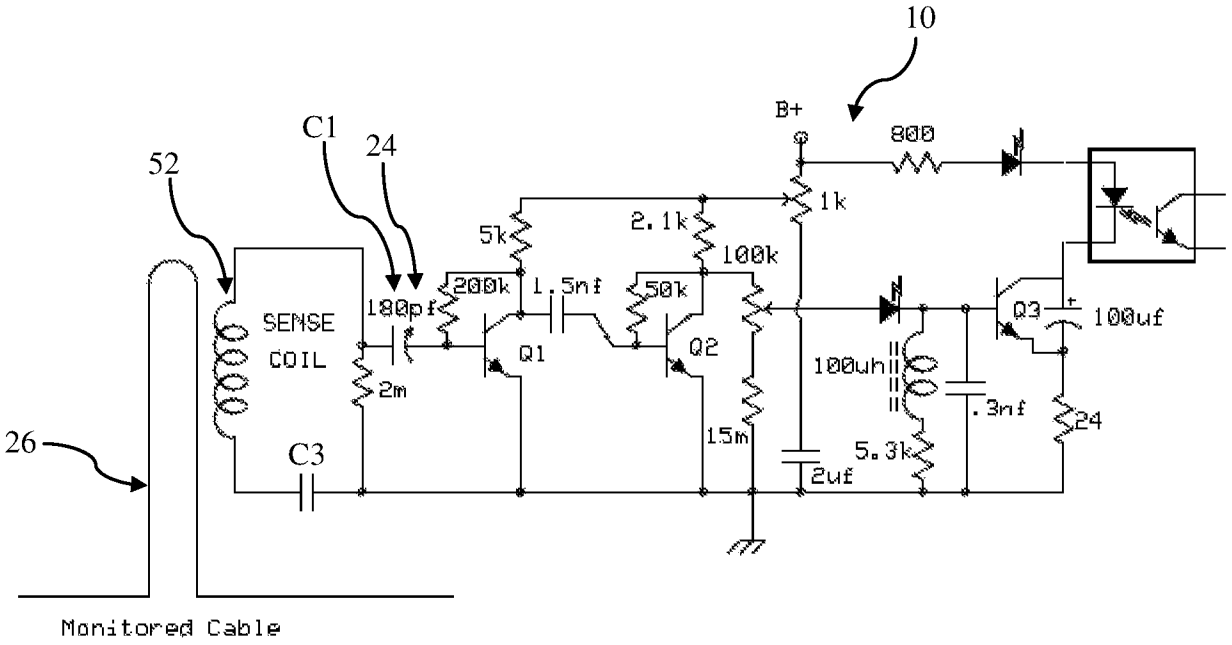
FIG. 6 shows a second embodiment of a metallic conductor disturbance detection device, in accordance with the second aspect of the invention.

Referring now to FIG. 6, a second embodiment of the metallic conductor disturbance detection device 10 will now be described. Like references refer to parts which are similar or identical to those of the first embodiment, and therefore further detailed description will be omitted. A portion of the driver circuit 18 from the opto isolator O1 and the alarm circuit 16 are omitted for ease of reference, as these match or substantially match those of FIGS. 1*a* and 1*b*. The device 10 comprises the sensing circuit 12, filter circuit 14, voltage regulation circuit 20, driver circuit 18 and alarm circuit 16, as before. The sensing circuit 12 includes the tuning circuit 24 and a modified amplification/oscillation circuit 28. The primary difference resides in the modified sensing circuit 12.

In this embodiment, the sensing circuit 12 has been adapted to include a sensing pick-up coil 52 at the input to the tuning circuit 24. The pick-up coil 52 is connected between the input of the tunable capacitor C1 and B− via a second capacitor C3 of small value, in the order of Nano or Pico Farads. This wireless connector permits the device 10 to be utilised in environments where a direct mechanical connection to the infrastructure 26 to be monitored has been deemed either hazardous or otherwise undesirable, for example, being AC or DC powered, or of another signal type. When such limitations are encountered, it has been found that employing the pick-up coil 52 in the configuration illustrated in FIG. 6 gives very good results.

It may also be advantageous to include electrical shielding to some degree in order to prevent or limit the circuits of the device 10 from becoming saturated with spurious RF interference.

Figure 7:
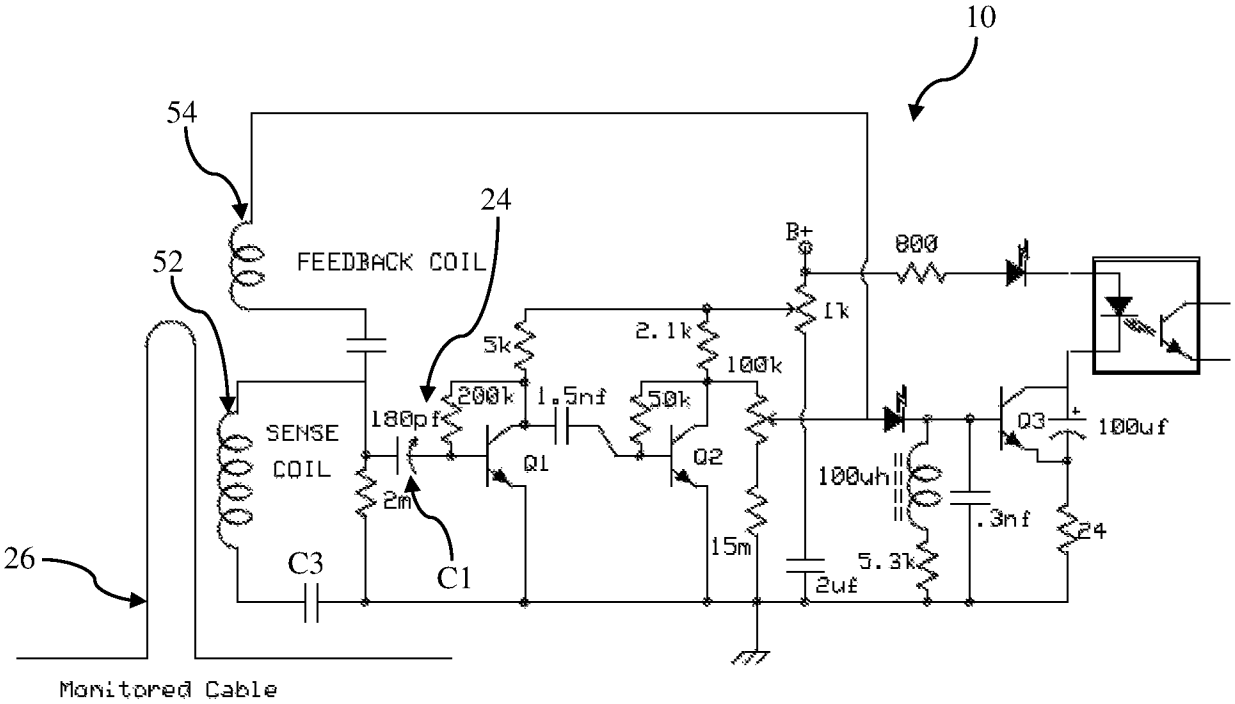
FIG. 7 shows a third embodiment of a metallic conductor disturbance detection device, in accordance with the second aspect of the invention.

Referring now to FIG. 7, a third embodiment of the metallic conductor disturbance detection device 10 will now be described. Again, like references refer to parts which are similar or identical to those of the first and second embodiments, and therefore further detailed description will be omitted, and as with FIG. 6 a portion of the driver circuit 18 from the opto isolator O1 and the alarm circuit 16 are omitted for clarity, as these match or substantially match those of FIGS. 1*a* and 1*b*.

The device 10 of the second embodiment comprises the sensing circuit 12, filter circuit 14, voltage regulation circuit 20, driver circuit 18 and alarm circuit 16, as before. The sensing circuit 12 includes the tuning circuit 24 and a further modified amplification/oscillation circuit 28. The primary difference resides again in the further modified sensing circuit 12.

The further modified sensing circuit 12 includes the sensing pick-up coil 52 at the input to the tuning circuit 24 and a tickler coil 54. A portion of the output signal from the filter circuit 14 is routed back to the input of the tuning circuit 24 and caused to act upon the pick-up coil 52 inductively in a manner similar to a regenerative feedback circuit. The sensing circuit 12 is thus rendered extremely sensitive to external RF signals.

It should be understood that combinations of the above examples and embodiments may be utilised.

In use, the preferred embodiments of the metallic conductor disturbance detection device 10 provide a single connection to the tuning circuit 24 from the external metallic infrastructure 26, and the tuning circuit 24 utilises a variable capacitor C1 to aid tuning.

The metallic conductor 34 of the infrastructure 26 to be monitored possesses qualities of RC&L and may thus be treated as a tuned or tunable circuit.

While in such cases the metallic conductor 34 may be in some manner grounded, it will none the less as mentioned above be influenced by ambient RF and other forms of electromagnetic fields present in both the atmosphere and within the earth.

Electrical oscillation is generated internally within the device 10 through feedback from the output stage of the filter circuit 14 back to the input stage via the B+ rail or trace line.

By adjusting the filter circuit 14 and voltage regulation circuit 20 via respective potentiometers, for example, and the tuning circuit 24 by the variable capacitor, for example, the frequency of oscillations can be adjusted to the point where a resonant condition is created. The device 10 is first energised and adjusted to a condition wherein the device 10 is close to an ideal resonant condition. As the variable capacitor C1 of the tuning circuit 24 is varied, the amplitude from the external circuit increases. At a certain point this amplitude will begin to effect the natural oscillation of the sensing circuit 12. This is due to the degree of saturation of the base of transistor Q1 by the increase in amplitude of the impressed signal reaching transistor Q1 via the variable RC&L infrastructure 26. At some point, this saturation will affect the natural frequency of the sensing circuit 12, whereby changing the frequency of the sensing circuit 12 causes the sensing to become extremely sensitive and may be considered in a near state of ideal resonance. If too great an amount of amplitude from the external infrastructure 26 is fed into the base of transistor Q1, the base becomes overly saturated and will send the sensing circuit 12 into full saturation wherein changes within the external infrastructure 26 being measured can no longer be detected. Therefore, it is important that an ideal setting of B+ beneficially settable by the voltage regulation circuit 20 and the amount of coupling between the amplification/oscillation circuit 28 and the external infrastructure 26 be maintained at an optimal value to ensure an ideal sensitivity be maintained at all times.

The tunable band pass filter 30 is in communication with an output of the amplification/oscillation circuit 28, and is set to allow frequencies of only a certain bandwidth to pass, while attenuating undesirable frequencies.

When the device 10 is connected to the metallic infrastructure 26 to be monitored, the device 10 must be tuned in such a manner that both the electromagnetic fields impressed on the metallic infrastructure 26 from external sources and the internally generated oscillation created by the circuits of the device 10 combine within the device 10 to produce an output frequency that will readily pass through the band pass filter 30.

Both frequency and amplitude are important for the proper operation of the circuit of the present invention.

Amplitude is primarily controlled by the adjustment of the variable capacitor C1 of the tuning circuit 24 at the input of the device 10. The variable capacitor C1 regulates the amount of signal reaching the amplification/oscillation circuit 28 from the metallic infrastructure 26.

When the device 10 has been tuned to the desired operating condition, wherein the output driver of transistor Q3 of the driver circuit 18 is biased to an ON or semi-ON condition such that no alarm condition is created, the device 10 is considered in "Standby Mode".

If a portion of the metallic infrastructure 26 is damaged, removed or disturbed in such a way that a change of inductance takes place within the infrastructure 26, this change affects both the resonant condition of the infrastructure 26 and also the amplitude of the detected electromagnetic fields present within the infrastructure 26.

These changes will conversely affect both the amplitude and internally generated frequency of the amplification/oscillation circuit 28, thereby changing the output signal feeding into the band pass filter 30 of the filter circuit 14.

Such changes may either increase both amplitude and frequency or decrease the same depending upon the nature of the external changes. This therefore changes the level of signal pass-through from the band pass filter 30 to the driver transistor Q3.

Depending on the nature of the change, either more or less signal may be passed by the band pass filter 30. The driver circuit 18 will either go to a HIGH state or a LOW state depending upon the nature of the change taking place. If the driver circuit 18 goes HIGH, for example due to a sharp increase in amplitude, more signal is permitted to pass through the band pass filter 30 as would be noted by a sudden increase of the intensity of LED 2. The null setting condition of the driver circuit 18 is affected, and one opto relay OR1, OR2 will respond by going to an open circuit condition. If the driver circuit 18 goes LOW due to a sharp decrease in amplitude of the impressed signal, the output frequency from the amplification/oscillation circuit 28 falls out of the spectrum of the band pass filter 30 and a restriction of biasing signal reaching the base of transistor Q3 causes transistor Q3 to either turn off or nearly so and therefore causes the null condition to become interrupted. The other opto relay OR1, OR2 will respond by going to an open circuit condition and a second alarm condition is therefore created. In each case, with an alarm condition activated, the alarm circuit 16 is energised to output an alarm signal. Preferably, the alarm circuit includes a transmitter for outputting the alarm signal to an offsite location.

It should be understood that the opto relays OR1, OR2 may be configured to where a closed state will be generated in alarm condition depending upon the application.

In a typical grounding infrastructure 26 to which this circuit is connected and having one or more metallic conductors 34 to be monitored, typically numerous "ground loops" are present. Ground loops are defined as parallel grounded structures communicating to a single point with metallic conductors 34 interconnecting the structures to form a single ground point where all structures are tied together. Electrically, these structures with interconnecting conductors tend to form parallel inductances forming the overall inductance of the infrastructure 26. When any portion of the overall inductive network formed by the infrastructure 26 is removed, the inductance changes. These changes can either manifest themselves as a change in the resonant frequency or amplitude of impressed RF, electromagnetic fields or both interacting with the grounded network thereby causing the network to change its RC&L characteristics. The change of the RC&L characteristics results in a sympathetic response or change in the resonant state of the device 10, thereby altering the frequency the device 10 is operating at. By careful tuning of the device 10 to a near resonant condition, this sympathetic response or change which is essentially a detuning of the previously tuned signal is readily identified via the band pass filter 30.

Depending on which portion of the grounding infrastructure 26 has been removed or altered, the tuned signal resulting from the previously set resonant condition becomes detuned due to the network imparting a higher state of resonance, considered a full ON state, or the resonant condition becomes detuned due to the network imparting a lower state of resonance, considered an OFF state. In either case, the filter circuit 14 identifies this detuning and an alarm can be generated via the alarm circuit 16 thereby alerting others that such changes have taken place within the monitored infrastructure 26.

Utilising the pick-up coils 52 of the second and third embodiments as inductive pickups allows the device 10 to be wirelessly inductively connected to the grounded infrastructure in order to monitor for a disturbance of any metallic conductor 34 therein.

In this arrangement, the inductive pick-up coil 52 essentially forms part of the amplification/oscillation circuit 28 with the tuning circuit 24 interposed therebetween. The oscillation generated by the amplification/oscillation circuit 28 flows within the pick-up coil 52. When the pick-up coil 52 is incorporated as in the second embodiment illustrated in FIG. 6, the pick-up coil 52 is rendered extremely sensitive to both external passive inductances, bodies of capacity, and stray ambient fields such as RF and/or electromagnetic.

In the case of a passive inductance in close proximity to the pick-up coil 52, the passive inductance comes under the influence of the field generated by the amplification/oscillation circuit 28 and the pick-up coil 52 wherein the two inductances tend to form a tuned circuit. If the passive inductance should be disturbed, such as by being moved, a portion of the same being removed, or otherwise being disturbed, the change in the inductive relationship of the two inductances will produce a shift in frequency and amplitude within the amplification/oscillation circuit 28 thereby causing the device 10 to ether fall into a greater or lesser resonant state thereby generating an alarm condition as described previously.

The device 10 is preferably housed in a metallic enclosure and may be conveniently rack mounted if required.

When it is desirable to incorporate an inductive pick-up coil 52, the device 10 can be placed alongside the structure or external circuit to be monitored. In this application, the circuit can be housed either in a non metallic enclosure or a combination non-metallic or metallic enclosure to permit the ease of inductive coupling between the device 10 and the monitored infrastructure 26.

It is also possible where necessary that a housing of the device 10 may be a weather tight enclosure and/or may be buried alongside buried conductors 34 or metallic structures. In this latter case, if the buried conductors 34 are disturbed, such as by sudden removal, the changes of inductance, frequency, amplitude or combination of all three will be sufficient to generate an alarm condition.

In a modified arrangement, if the monitored infrastructure 26 is energized by an electrical current or conveys an RF signal, the electromagnetic field will interact with the oscillation present within the pick-up coil 52 when the two are inductively coupled, as described above. If a significant change occurs, such as the signal being interrupted or the circuit becoming broken in some manner, the resonant condition of the device 10 will become altered thereby generating an alarm condition in the same manner as previously described.

The use of the tickler coil 54 mentioned in relation to the third embodiment and being in close inductive relationship with the pick-up coil 52 is also beneficial in order to increase the sensitivity within the pick-up coil 52. This enables detection of even more subtle changes taking place within the monitored network. When the device 10 has been properly tuned, it is rendered into a highly sensitive state of resonance owing to the additional inductive feedback path afforded by the tickler coil 54. When employed to monitor an external metallic infrastructure 26, even slight changes of the RC&L state of the monitored infrastructure 26 will cause sufficient changes within the circuit to produce the desired alarm condition already alluded to, and such changes may arise from any disturbance including the introduction of a foreign body having a capacity, such as an unauthorised person, into close proximity with the infrastructure 26. As such, the device 10 can be used as a proximity detector.

If the pick-up coil 52 utilises an iron or ferrite core, the device 10 can be rendered sensitive to detect the movement of magnetic fields or metal objects within a distance of several feet from the pick-up coil 52. In this arrangement, it could be employed as a means of detecting the movement of metal structures composed of iron or steel as these metals tend to possess some degree of natural magnetism.

Although the tuning circuit is described as utilising a variable capacitor, any other suitable capacitance adjustment means can be utilised. Additionally or alternatively, it is feasible that a variable inductor could be utilised. In this case, two inductively coupled parallel coils could be or form part of the variable inductor. By moving the coils physically relative to each other, the inductance can be varied. Optionally, if the variable inductor utilises a ferrite core, then an adjustment may be made to the core to vary the inductance.

Other methods of band pass filtering of the output of the amplification/oscillation circuit 28 may be utilised, such as employing a comparator circuit. When the proper adjustments have been made to the B+ and the series variable capacitor C1 communicating with the base of transistor Q1, a frequency of a certain bandwidth is permitted through the band pass filter 30 to drive the third transistor Q3 employed to control the output comprising the alarm circuit 16 of the device 10. Providing this is achievable, then any suitable filter circuit can be utilised.

Furthermore, the band pass filter may be configured in any suitable form. By way of example, resistor R8 could be variable such as in the form of a potentiometer, coil 32 could be a variable core choke, and/or variable capacitor C2 could be a fixed capacitor. At least one of these elements should be variable to enable tuning. However, it could be possible to tune the band pass filter, for example, prior to installation, and then fix the components so that further tuning is not possible or not required.

Figure 8:
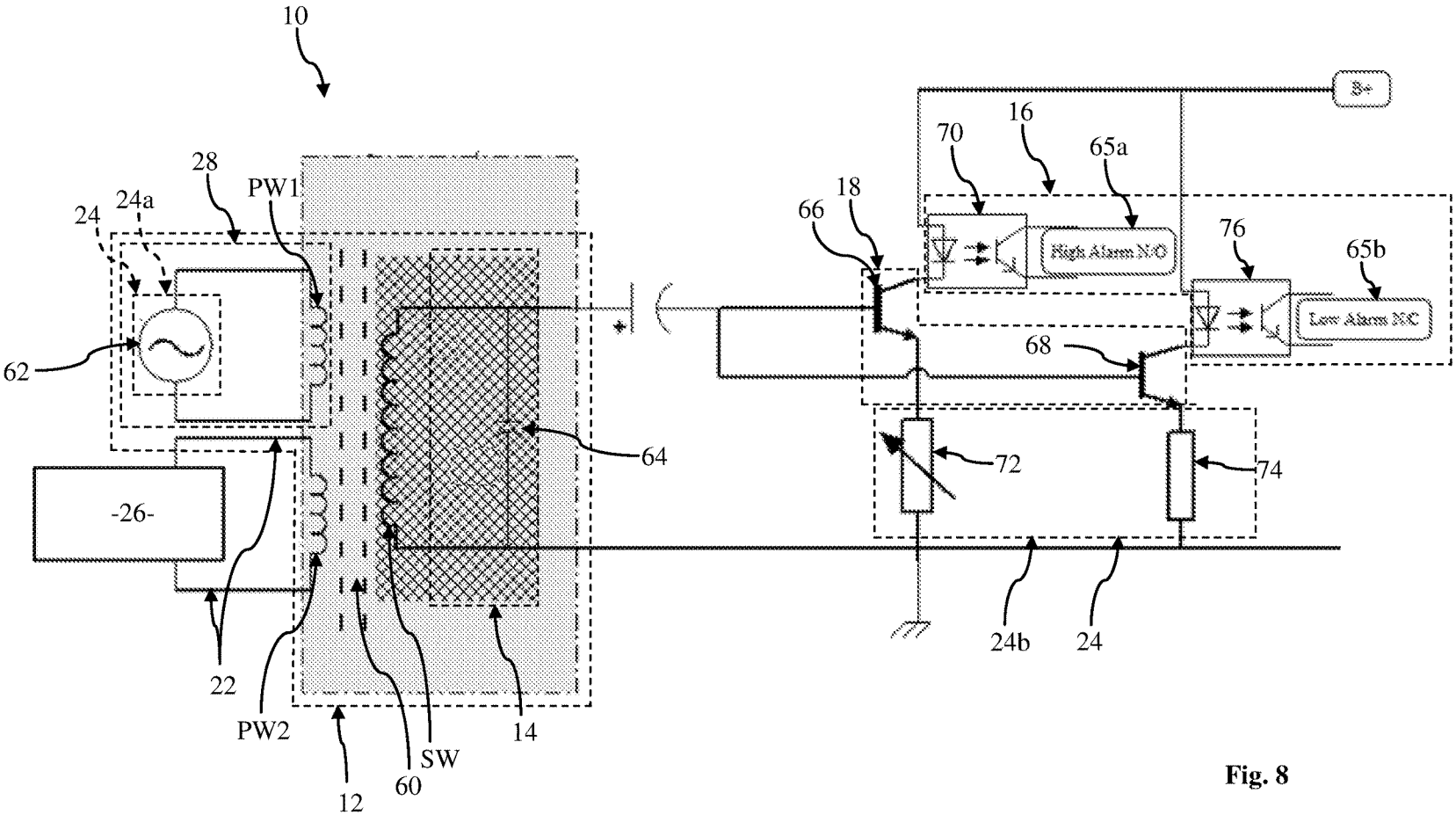
FIG. 8 shows a fourth embodiment of a metallic conductor disturbance detection device, in accordance with the second to fifth aspects of the invention.

Referring now to FIG. 8, a fourth embodiment of the metallic conductor disturbance detection device 10 will now be described. References which are the same as those used in the preceding embodiments refer to similar or identical parts, and therefore further detailed description will be omitted.

The circuit diagram of FIG. 8 is simplified for clarity.

The device 10 comprises the sensing circuit 12, filter circuit 14, voltage regulation circuit (not shown), driver circuit 18 and alarm circuit 16, as before.

The sensing circuit 12 and filter circuit 14 may be combined. The filter circuit 14 of this embodiment comprises at least capacitor 64, thereby effectively presenting a wide pass band filter. Additional filter circuitry could be utilised to provide a more preferable narrow pass band filter.

The primary difference in this embodiment resides in the modified sensing circuit 12.

In this embodiment, the sensing circuit 12 has been adapted to include a series wound ferro-resonant transformer 60 with first and second primary windings PW1 and PW2 on the metallic infrastructure side, along with a secondary winding SW on the alarm circuit side.

An oscillating signal, preferably at 34 kHz in this particular case, is provided to first primary winding PW1 by an oscillating power source or oscillator 62. This may be sympathetic to the LC circuit or tank circuit comprising secondary winding SW and capacitor 64. Although possibly sympathetic, in the current embodiment, operation may occur at or around half resonant frequency. Other frequencies may also be possible. The oscillating signal is not at the transformer's specific resonant frequency. The oscillating signal has been shown to operate well in a range of 20 kHz to 50 kHz, and is largely dependent on the specific transformer 60 utilised.

Although preferable, the capacitor 64 can be dispensed with, although this tends to decrease sensitivity.

The oscillating signal in primary winding PW1 induces a voltage at the secondary winding SW. This voltage is proportional to both the input signal at the primary winding PW1 and the inductive influence of the metallic infrastructure 26 mechanically and electrically attached via sense wires 22 to the second primary winding PW2. An electromagnetic field is impressed onto the metallic infrastructure by the oscillator via the first and second primary windings PW1 and PW2.

Any subsequent increase or decrease in the inductance of the metallic infrastructure 26 mechanically and electrically attached to the second primary winding PW2 results in measurable changes to the output voltage and current of the secondary winding SW. This output can be fine tuned by decreasing or increasing the amplitude and/or frequency of the signal being fed from the oscillator 62 into the first primary winding PW1. As such, oscillator 62 effectively forms a first part 24*a* of a two-part tuning circuit 24.

In a modification, the output can be further fine tuned by the addition of a variable inductor either in series or in parallel with the network sense wires 22, metallic infrastructure 26 and/or the second primary winding PW2.

The amplitude of the signal fed into the first primary winding PW1 is adjusted, so that an output of the secondary winding SW via a connected output amplifier produces just enough voltage and current not to energise the HIGH alarm circuit 65*a* via driver transistor 66 of driver circuit 18, but to energise the LOW alarm circuit 65*b* via driver transistor 68 of driver circuit 18 and opto-relay 70. LOW alarm circuit 65*b*, in this case, is held in a steady state.

A voltage differential between the setting of the HIGH and LOW alarm states is adjusted with variable resistor 72 on the emitter of driver transistor 66. Variable resistor 72 and resistor 74 form a second part 24*b* of the two-part tuning circuit 24. This enables the changes in signal voltage imparted to the secondary winding SW to be very small allowing triggering of the high or low alarm event.

Although variable resistor 72 is beneficially on the emitter of driver transistor 66, it may be on the base of driver transistor 66, in which case an additional, preferably fixed, resistor would be on the emitter. The variable resistor 72 or a further variable resistor may also be on the emitter of driver transistor 68. The variable resistor 72 may be interchangeable with resistor 74. This interchangeability allows adjustment of the alarm portion 16 for variance in component tolerances of the opto-relay chips or other suitable relay devices 70 and 76.

If both HIGH and LOW alarms are in an energised state, variable resistor 72 can be adjusted by altering its resistance until the HIGH alarm is de-energised. The alarm circuit 16 remains in a steady OK state with the HIGH alarm in a de-energised state and LOW alarm in an energised state. If using an N/C device for the HIGH alarm and an N/O device for the LOW alarm then the alarm conditions themselves can be used as an indicator to fine tune the sensor circuit 12 via the amplitude of the oscillator 62, once the trigger values between HIGH and LOW have been suitably adjusted.

Once at a steady state, any increase in inductance of the metallic infrastructure 26 attached to the second primary winding PW2 caused by disconnection of any or all of the metallic networked parts will cause a discernible rise in voltage at the secondary winding SW. This energises the HIGH alarm circuit 65*a* via its opt-relay 70 and causes an alarm to activate.

Similarly, any decrease in inductance of the monitored network 26 attached to the second primary winding PW2, caused for example by adding additional metallic infrastructure such as when attempting to defeat the alarm prior to removal of targeted material, will cause a detectable fall in voltage at the secondary winding SW. This de-energises the LOW alarm circuit 65*b* via its opto-relay 76, causing the alarm to again activate.

Any attempt to circumvent the alarm by removing or tampering with the remote sense wires 22 will result in a detectable increase in inductance which will send the HIGH alarm into an ON state.

Being able to 'lock' the signal frequency of the oscillator 62 is beneficial, since it allows 'one knob' setup and control of the entire circuit via adjustment of the amplitude of oscillator 62 once the variable resistor 72 has been set. However, the amplitude of the signal outputted by the oscillator 62 could be locked instead, wherein the frequency is controlled to tune the inductance sensing circuit 12. Alternatively, the amplitude and the frequency of the oscillating signal outputted by the oscillator 62 may be controllable to tune the inductance sensing circuit 12.

In the above cases, it is preferable to only require a single variable to be controllable during installation, and therefore during production of the detection device 10, the variable resistor 72 and one of the frequency and amplitude of the oscillating signal are set. Any suitable drivers 66 and 68 could be utilised. These may be solid state or mechanical. Multiple opto-relays or solid state relays on a chip may be considered. The ability to detect theft of the metallic infrastructure on site the instant the process is started, enables quick action to make the site safe, bring it back into service and possibly catch the thieves. The alarm circuit of device energises an alarm that can be used for engineer dispatch and/or security personnel. In addition, it is possible that the device could be used to trigger an alternative mechanism or system, such as audible, visual and/or tactile alarm or 'dye bomb'.

Due to the nature of the detection process, circumvention is extremely difficult.

The circuit of the present invention differs greatly from the prior art in the fact that it measures the inductance within the metallic infrastructure and senses changes of inductance taking place within the structure when portions of it are disturbed, such as by removal or tampering.

It is therefore possible to provide a metallic conductor disturbance detection device that is designed to detect inductive changes taking place within grounded or non-grounded metallic conductors. The sensing circuit of the device is connected to an alarm circuit, whereby remote or offsite notification of any disturbance is relayed. The present invention is intended to be used in applications where large bodies of metallic conductors, such as copper cabling and ground conductors, are employed, for example, in telecoms, power generation & distribution, rail transport and other markets that make wide use of large quantities of copper or other valuable metals. It is also possible to utilise the device to monitor for natural degradation or disturbance of metallic conductors due to corrosion or damage inflicted due to accidental conditions, and to provide an alarm to indicate that such conditions have occurred.

The embodiments described above are provided by way of examples only, and various other modifications will be apparent to persons skilled in the field without departing from the scope of the invention as defined by the appended claims.

The invention claimed is:

1. A method of detecting disturbance in a metallic conductor of a monitored infrastructure, the method comprising the steps of providing an inductance sensing circuit including a transformer having a first primary coil and a second primary coil on a metallic conductor side, and a secondary coil on an alarm circuit side, the first primary coil being supplied on a first circuit with an internally generated circuit oscillation by an oscillating power source or oscillator, the second primary coil being physically and electrically connected to the said metallic conductor having a monitorable inductance on a second circuit which is independent of the first circuit such that the oscillating power source or oscillator is not directly connected to the metallic conductor, tuning the inductance sensing circuit based on an electromagnetic field impressed upon the metallic conductor and the internally generated circuit oscillation into the first primary coil, wherein the inductance sensing circuit is tuned as a function of the monitorable inductance on the second circuit, and outputting an alert signal when a tuned output signal from the tuned inductance sensing circuit becomes detuned due to a change in inductance of the metallic conductor by alteration to or removal of at least a portion of the metallic conductor.

2. The method as claimed in claim 1, wherein the tuned output signal of the tuned inductance sensing circuit is outputted to a filter circuit filtering based on frequency of the tuned signal.

3. The method as claimed in claim 2, wherein the filter circuit includes a band-pass filter.

4. The method as claimed in claim 1, wherein the first primary coil is connected to an oscillator, wherein a frequency of a signal outputted by the oscillator is locked, and the inductance sensing circuit is tuneable based on an amplitude of a signal outputted by the oscillator.

5. The method as claimed in claim 1, wherein the first primary coil is connected to an oscillator, wherein the inductance sensing circuit is tuneable based on an amplitude and frequency of a signal outputted by the oscillator.

6. The method as claimed in claim 1, wherein the first primary coil is connected to an oscillator, wherein an amplitude of a signal outputted by the oscillator is locked, and the inductance sensing circuit is tuneable based on a frequency of a signal outputted by the oscillator.

7. The method as claimed in claim 1, wherein the alert signal is outputted to an alert device which is remote of the inductance sensing circuit installation.

8. The method as claimed in claim 1, wherein the monitorable infrastructure is or is part of a grounded metallic infrastructure including, at least one of a mobile phone mast, a substation, and a utility service.

9. A metallic conductor disturbance detection device for a method of detecting disturbance in a metallic conductor as claimed in claim 1, the device comprising an amplitude and/or frequency tuneable inductance sensing circuit, and an alarm circuit which outputs an alarm signal based on an output of the inductance sensing circuit by alteration to or removal of at least a portion of the metallic conductor, the inductance sensing circuit including a series-wound transformer having first and second primary windings and a secondary winding, an oscillator in electrical communication with the first primary winding on a first circuit, the inductance sensing circuit being physically and electrically connected to the metallic conductor via the second primary winding on a second circuit which is independent of the first, circuit such that the oscillator is not directly connected to the metallic conductor, and the secondary winding being in communication with the alarm circuit.

10. The metallic conductor disturbance detection device as claimed in claim 9, further comprising a filter circuit connected to an output of the inductance sensing circuit.

11. The metallic disturbance detection device as claimed in claim 9, further comprising a tuning circuit which tunes the inductance sensing circuit, the tuning circuit providing the internal circuit oscillation which impresses the electromagnetic field on the metallic conductor, wherein the tuning circuit is a two-part tuning circuit having an amplitude tuner and a resistance tuner.

12. The metallic conductor disturbance detection device as claimed in claim 11, wherein the amplitude tuner is upstream of the first primary winding of the transformer, and the resistance tuner is downstream of the secondary winding of the transformer.

13. The metallic conductor disturbance detection device as claimed in claim 9, wherein the alarm circuit includes a transmitter for outputting the alarm signal to an offsite location, and wherein the transmitter is a wireless transmitter.

14. The metallic conductor disturbance detection device as claimed in claim 9, further comprising a driver circuit for driving the inductance sensing circuit and/or the alarm circuit.

15. A metallic conductor disturbance detection device for detecting disturbance in a metallic conductor of a monitorable infrastructure, the device comprising an inductance sensing circuit having a two-part tuning circuit, a first part of the two-part tuning circuit including a transformer having first and second primary windings and a secondary winding, and a tuneable oscillator in electrical communication with the first primary winding of the series-wound transformer on a first circuit, the inductance sensing circuit having a monitorable inductance and being physically and electrically connected to the metallic conductor via the second primary winding on, a second circuit which is independent of the first circuit such that the oscillator is not directly connected to the metallic conductor, wherein the inductance sensing circuit is configured to be tuned as a function of the monitorable inductance, and a second part of the two-part tuning circuit comprising an alarm circuit coupled with a variable resistor, the alarm circuit outputting an alarm signal based on an output of the inductance sensing circuit by alteration to or removal of at least a portion of the metallic conductor, the transformer, the variable resistor being adjustable to set a trigger value of the alarm circuit, and the secondary winding being able to output a tuned output signal to the alarm circuit based on a first condition of the metallic infrastructure, and a detuned output signal to the alarm circuit based on a second condition of the metallic infrastructure caused by alteration to or removal of at least a portion of the metallic conductor.

* * * * *